US007500558B2

(12) United States Patent
Tanbo

(10) Patent No.: US 7,500,558 B2
(45) Date of Patent: Mar. 10, 2009

(54) SOFT PACKAGE OF ROD-SHAPED SMOKING ARTICLES, INNER AND OUTER WRAPPERS FOR SAME

(75) Inventor: Hitoshi Tanbo, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 11/798,441

(22) Filed: May 14, 2007

(65) Prior Publication Data

US 2007/0284268 A1 Dec. 13, 2007

Related U.S. Application Data

(63) Continuation of application No. PCT/JP2005/020631, filed on Nov. 10, 2005.

(30) Foreign Application Priority Data

Nov. 17, 2004 (JP) ..... 2004-333294

(51) Int. Cl.
*B65D 85/10* (2006.01)

(52) U.S. Cl. ..... 206/268; 206/273; 229/87.12; 229/160.1

(58) Field of Classification Search ..... 206/264, 206/265, 268, 271, 273; 229/87.12, 160.1
See application file for complete search history.

(56) References Cited

U.S. PATENT DOCUMENTS

| | | | | |
|---|---|---|---|---|
| 3,260,405 | A * | 7/1966 | Frischer et al. | 206/273 |
| 5,529,180 | A * | 6/1996 | Paolucci et al. | 206/273 |
| 6,237,760 | B1 | 5/2001 | Parker et al. | |
| 6,494,318 | B1 | 12/2002 | Focke et al. | |
| 6,715,605 | B1 | 4/2004 | Manservigi et al. | |
| 6,755,300 | B2 * | 6/2004 | Brizzi | 206/273 |

FOREIGN PATENT DOCUMENTS

JP 7-149342 A 6/1995

* cited by examiner

*Primary Examiner*—Luan K Bui
(74) *Attorney, Agent, or Firm*—Birch, Stewart, Kolasch & Birch, LLP

(57) ABSTRACT

A soft package of filter cigarettes comprises an inner pack 10 of an almost rectangular parallelepiped and containing a cigarette bundle CB, and an envelope 12 of an almost rectangular parallelepiped and covering the inner pack 10 except for a top face 28 of the inner pack 10. The envelope 12 has slant edges 20 at the four corner edges extending along the longitudinal direction of the inner pack 10, and the slant edges 20 impart an octagonal cross section to the envelope 12.

7 Claims, 9 Drawing Sheets

SOFT PACKAGE OF ROD-SHAPED SMOKING ARTICLES, INNER AND OUTER WRAPPERS FOR SAME

This application is a Continuation of copending PCT International Application No. PCT/JP2005/020631 filed on Nov. 10, 2005, which designated the United States, and on which priority is claimed under 35 U.S.C. § 120. This application also claims priority under 35 U.S.C. § 119(a) on Patent Application No(s). 2004-333294 filed in Japan on Nov. 17, 2004. The entire contents of each of the above documents is hereby incorporated by reference.

TECHNICAL FIELD

This invention relates to a soft package of rod-shaped smoking articles such as filter cigarettes, and inner and outer wrappers for forming the package.

BACKGROUND ART

As packages of filter cigarettes, a soft package and a hard package are known. The hard package is also called a hinge lid package.

Such packages contain an inner pack, and the inner pack is formed by wrapping a bundle of filter cigarettes in an inner wrapper. Both the soft and hard packages have an outer shape of rectangular parallelepiped. In particular, the outer box of the hinge lid package has four longitudinal angular edges, and each angular edge forms a right angle. Thus, the hinge rid package has a simple outer shape, which is aesthetically not fine for the package of articles of taste such as filter cigarettes.

In order to give a unique outer shape to the hinge lid package, for example, a hinge lid package disclosed in U.S. Pat. No. 6,715,605 has been proposed. The outer box of this known package has four slant edges of a small width, in place of the four angular edges, where the slant edges impart an octagonal transverse cross section to the outer box.

Such octagonal outer shape of the hinge lid package recalls the round profile of filter cigarettes and is thought to be suitable for the filter cigarette pack.

Unlike the hinge lid package, regarding the soft package, however, there exist only those having a simple outer shape of rectangular parallelepiped, and an aesthetically fine soft package is desired.

A primary object of this invention is to provide a soft package of rod-shaped smoking articles having an outer shape other than an outer shape of rectangular parallelepiped, and inner and outer wrappers suitable for forming such soft package.

DISCLOSURE OF THE INVENTION

In order to achieve this object, a soft package according to this invention comprises an inner pack of an almost rectangular parallelepiped, the inner pack including a bundle of rod-shaped smoking articles and an inner wrapper covering the bundle, and an envelope of an almost rectangular parallelepiped, the envelope covering the inner pack except for a top face of the inner pack and including four corner edges extending along the longitudinal direction of the inner pack, wherein the envelope further includes slant edges formed at the corner edges, respectively, said slant edges imparting an octagonal transverse cross section to the envelope.

The above-described soft package has an octagonal transverse cross section and therefore differs in outer shape from normal soft packages having a rectangular parallelepiped.

Such soft package not only achieves clear differentiation from the normal soft packages, but also looks fine. In addition, the octagonal transverse cross section of the soft package strongly recalls the fact that the articles contained in the soft package are rod-shaped smoking articles.

Specifically, the envelope of the soft package is formed by folding an outer wrapper around the inner pack and includes an outer bottom face of a rectangular shape covering a bottom face of the inner pack, and the outer bottom face includes a pair of end flaps located at the opposite ends of the outer bottom face, a pair of trapezoidal side flaps extending along each side edge of the outer bottom face and laid one on the other on the end flaps, and tucks extending from the slant edges, respectively, and each lying between one of the end flaps and one of the side flaps, partly covered by the relevant side flap and partly exposed.

The tucks are not only useful for maintaining the shape stability of the slant edges of the envelope, but also contribute much to differentiation from normal soft packages because of their unique folded manner, which is seen at the outer bottom face of the envelope and makes it look quite different from the outer bottom face of normal soft packages.

Desirably, also the inner pack has slant edges corresponding to the slant edges of the envelope and therefore has an octagonal transverse cross section like the envelope, and also has tucks similar to the tucks of the envelope, at the top and bottom faces thereof. In this case, since the top face of the inner pack is not covered by the envelope but exposed, the tucks at the top face are clearly seen, so that their unique folded manner can attract attention visually.

This invention also provides outer and inner wrappers for forming the above-described envelope and inner pack, which will become clear from the explanation given below.

BEST MODE FOR CARRYING OUT THE INVENTION

Figure 1:
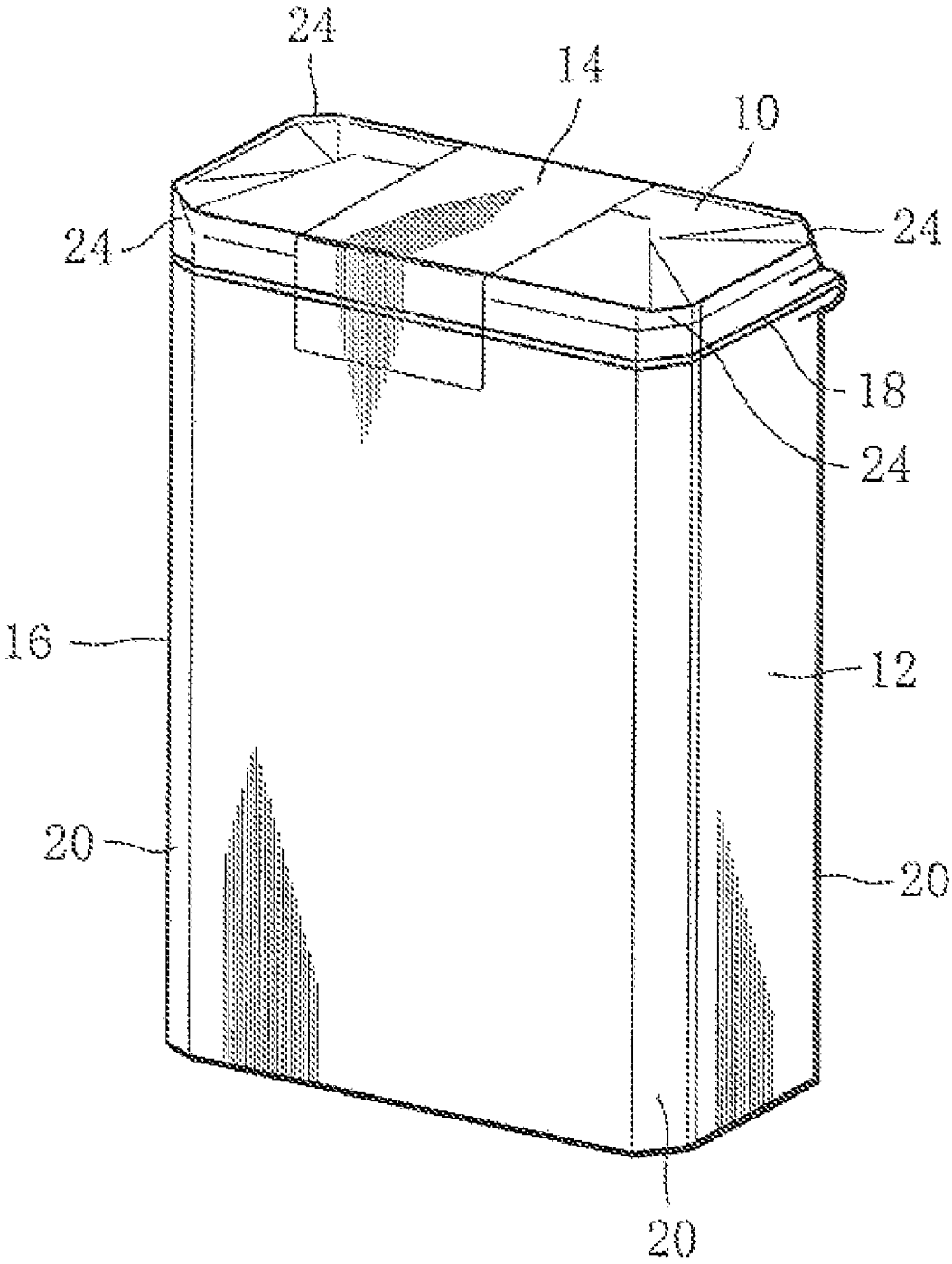
FIG. 1 A perspective view showing an embodiment of soft package.

FIG. 1 shows an embodiment of soft package.

The soft package comprises an inner pack 10 having outer shape of an almost rectangular parallelepiped. The inner pack 10 includes a bundle having, for example 20 filter cigarettes arranged in three layers, and an inner wrapper covering the cigarette bundle. For the inner wrapper, aluminum-vapor-deposited paper can be used.

Except for the rectangular top face, the inner pack 10 is covered by an envelope 12 of almost rectangular parallelepiped. Specifically, the envelope 12 has a front face, a back face, two side faces and a bottom face, and is formed by folding an outer wrapper around the inner pack 10.

The soft package further comprises a seal 14, and the seal 14 is stuck to the envelope 12 and the inner pack 10 to extend from the front face of the envelope 12 to the back face of the envelope 12, passing across the top face of the inner pack 10, in the center.

The soft package further comprises a transparent film 16, and the film 16 covers the envelope 12 and the top face of the inner pack 10. The film 16 has a tear tape 18 and the tear tape 18 is located at the upper end of the envelope 12.

The envelope 12 has a slant edge 20 between the front face and each side face and between the back face and each side face. The four slant edges 20 have a small width and extend along the longitudinal direction of the inner pack 10, from the upper end to the bottom of the envelope 12. These slant edges 20 impart an octagonal transverse cross section to the envelope 12, and therefore to the soft package.

Figure 2:
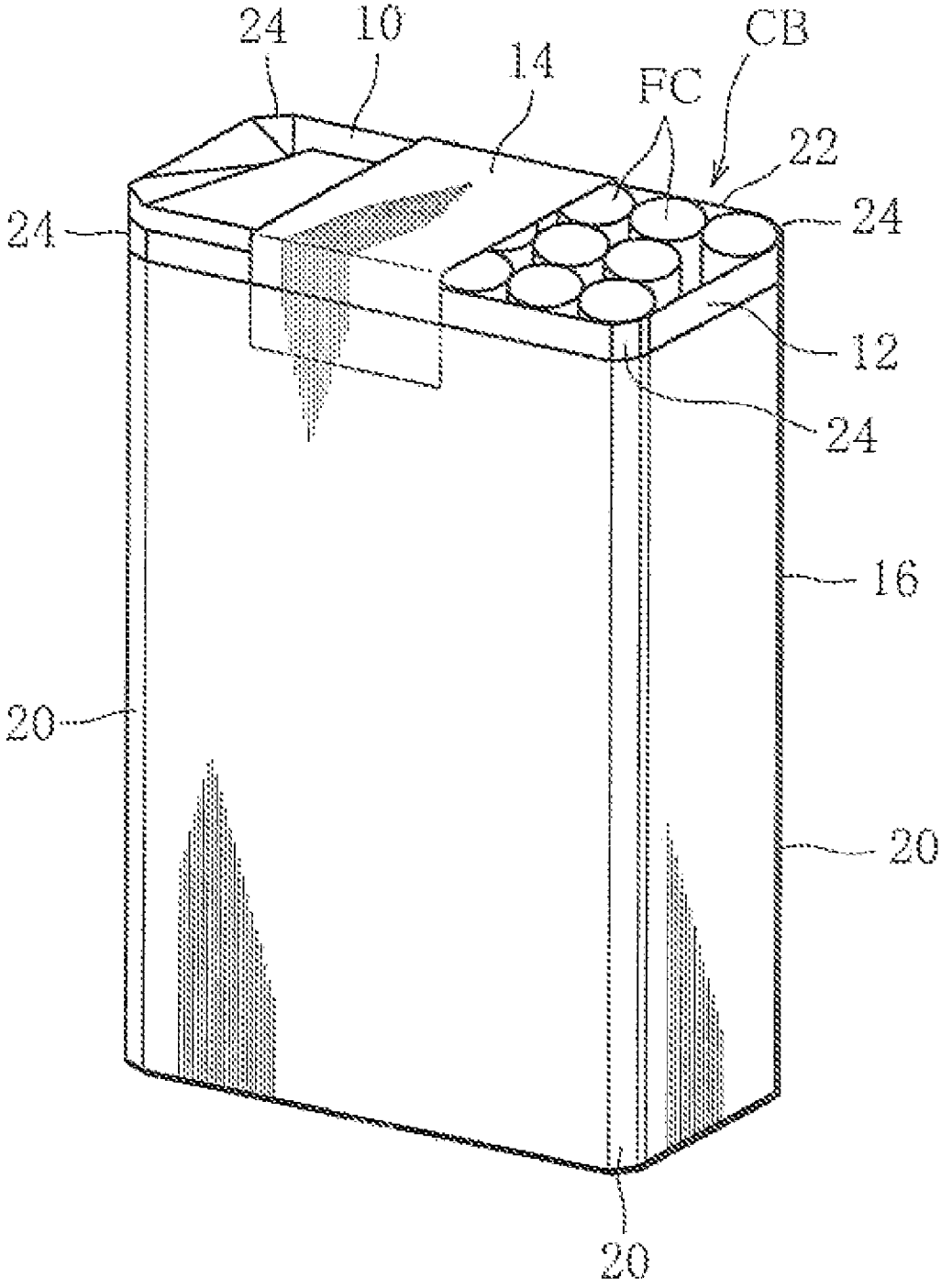
FIG. 2 A perspective view showing the soft package of FIG. 1 when it is opened.

In order to take out a filter cigarette from the soft package shown in FIG. 1, first the film 16 is torn along the tear tape 18 and the part of the film 16 which covers the top face of the inner pack 10 is removed. Thus, the top face of the inner pack 10 becomes exposed. Then, the part of the inner wrapper which forms the top face of the inner pack 10 is partly ripped off avoiding the seal 14, so that an opening 22 is formed in the top face of the inner pack 10 as shown in FIG. 2. The opening 22 exposes part of the cigarette bundle CB, and the filter cigarettes FC forming the cigarette bundle CB are taken out through the opening 22.

Since the envelope 12 has the four slant edges 20, the present embodiment of the soft package has an octagonal transverse cross section and therefore presents an appearance differentiated from normal soft packages.

The envelope 12 with the slant edges 20 imparts a rounded appearance to the soft package, and such rounded appearance of the soft package recalls the round profile of the filter cigarette. Thus, the soft package suitable for the filter cigarettes is provided.

As shown in FIGS. 1 and 2, also the inner pack 10 has four slant edges 24. The slant edges 24 extend along the longitudinal direction of the filter cigarettes FC, from the top face to the bottom face of the inner pack 10, and meet the corresponding slant edges 20 of the envelope 12, respectively. Thus, the upper ends of the slant edges 24 are seen at the top face of the inner pack 10, and therefore it is clearly seen that the inner pack 10 as well as the envelope 12 has an octagonal transverse cross section. Also in this respect, the present embodiment of the soft package has an appearance quite different from normal soft packages, and thus, it is more clearly differentiated from the normal soft packages.

Figure 3:
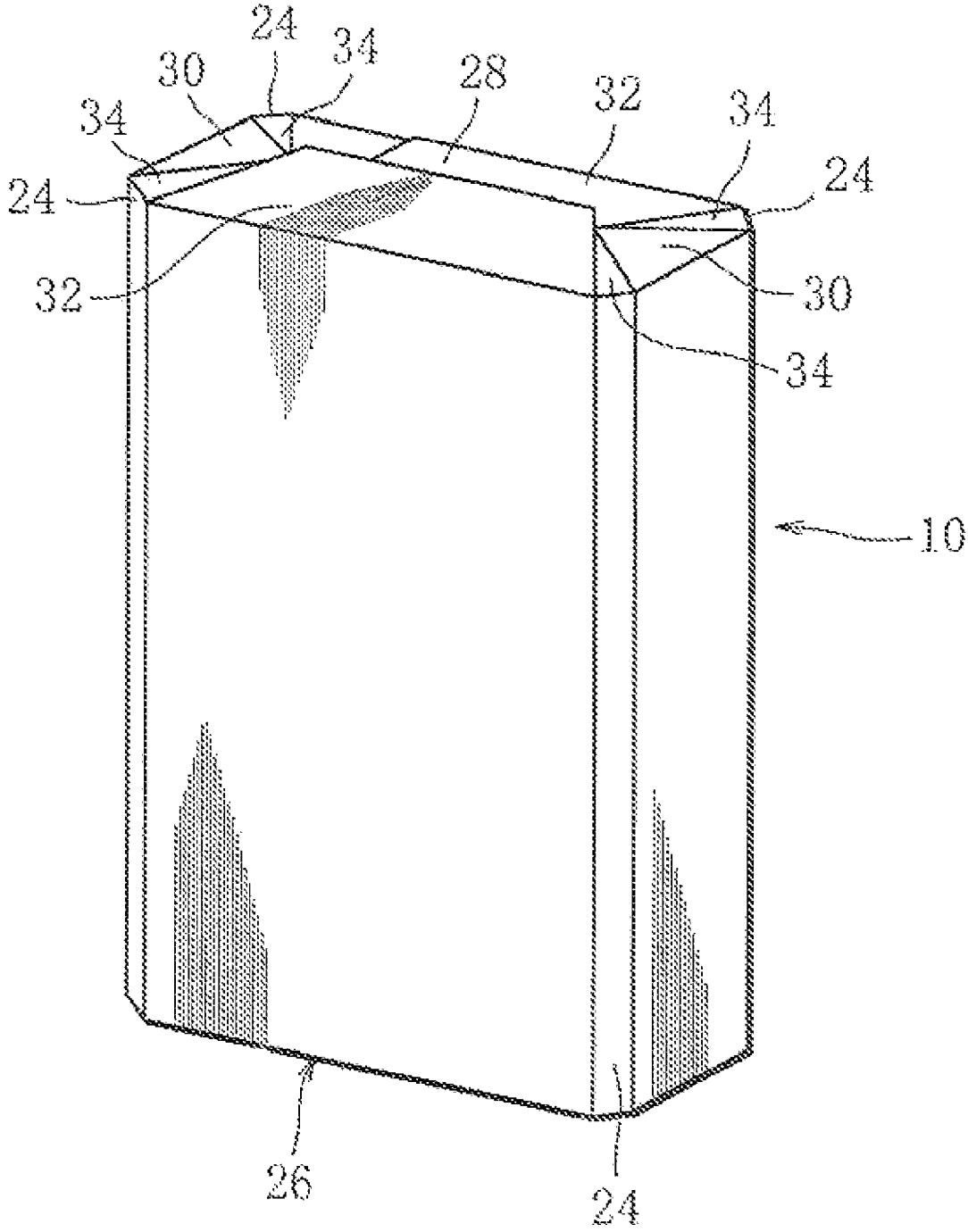
FIG. 3 A perspective view showing an inner pack of the soft package of FIG. 1.

FIG. 3 shows the whole inner pack 10, where how the inner wrapper 26 is folded is clearly shown.

The rectangular top face 28 of the inner pack 10 is formed as a closure surface covering the upper end face of the cigarette bundle by folding the inner wrapper 26. More specifically, the top face 28 includes a pair of end flaps 30 located at the opposite ends thereof, a pair of trapezoidal side flaps 32 laid one on the other on the end flaps 30, and four tucks 34 at the four corners of the top face 28. Each tuck 34 extends from the corresponding slant edge 24 of the inner wrapper 26, and has a distal end located between the end flap 30 and the side flap 32 and a proximal end not covered by the side flap 32 but exposed.

The bottom face (not shown) of the inner pack 10 is formed as a closure surface covering the lower end face of the cigarette bundle CB by folding the inner wrapper 26, in the same manner as the top face 28.

Figure 4:
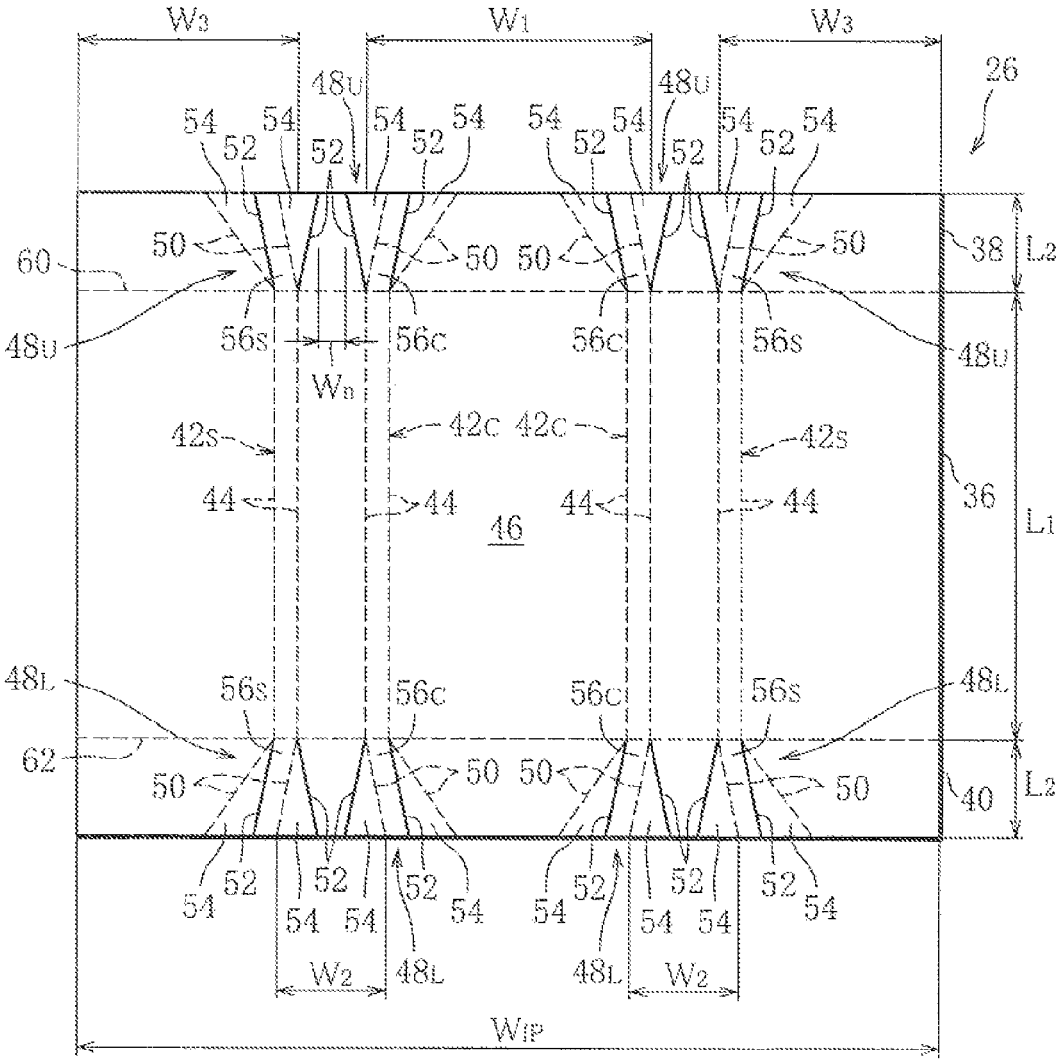
FIG. 4 A diagram showing an inner wrapper for forming the inner pack, in an unfolded state, FIG. 5 A perspective view showing the inner wrapper of FIG. 4 bent into a U-shape around a cigarette bundle.

FIG. 4 shows a backside of the inner wrapper 26 in an unfolded state.

As clear from FIG. 4, in order to enable the formation of the slant edges 24 and closure surfaces (upper face 28 and bottom face), the inner wrapper 26 has fold lines which normal inner wrappers do not have.

More specifically, the inner wrapper 26 includes a rectangular main section 36 in the center, and upper and lower sections 38, 40 adjacent to the main section 36 in the upper and lower positions, respectively. The main section 36 and upper and lower sections 38, 40 have the same width $W_{IP}$. The width $W_{IP}$ is somewhat greater than the girth of the cigarette bundle CB. Thus, when the inner wrapper 26 is wrapped around the cigarette bundle CB, the opposite side ends of the inner wrapper 26 are laid one on the other.

As clear from FIG. 4, the main section 36 has a length $L_1$, while the upper and lower sections 38, 40 have a length $L_2$. The length $L_1$ corresponds to the length $L_{CB}$ of the cigarette bundle CB (filter cigarettes FC) (see FIG. 5), and the length $L_2$ is a predetermined length longer than the height $H_{CB}$ of the cigarette bundle CB (see FIG. 6).

As indicated in dashed line, the main section 36 includes two band regions $\mathbf{42}_C$ and two band regions $\mathbf{42}_S$, and the band region $\mathbf{42}_C$ and the band region $\mathbf{42}_S$ are a predetermined distance apart from each other, in the direction of the width of the main section 36. When the cigarette bundle CB is wrapped in the inner wrapper 26 to form the inner pack 10, the band regions $\mathbf{42}_C$, $\mathbf{42}_S$ form the above-mentioned slant edges 24.

More specifically, each band region 42 is defined by a pair of mountain fold lines 44. The pair of mountain fold lines 44 extend parallel to each other, along the length of the main section 36. The distance between the pair of mountain fold lines 44 is somewhat greater than one fourth of the circumference of the filter cigarette FC. The mountain fold lines 44 are lines impressed on the backside of the inner wrapper 26 to stand out on the front side of the inner wrapper 26.

Figure 6:
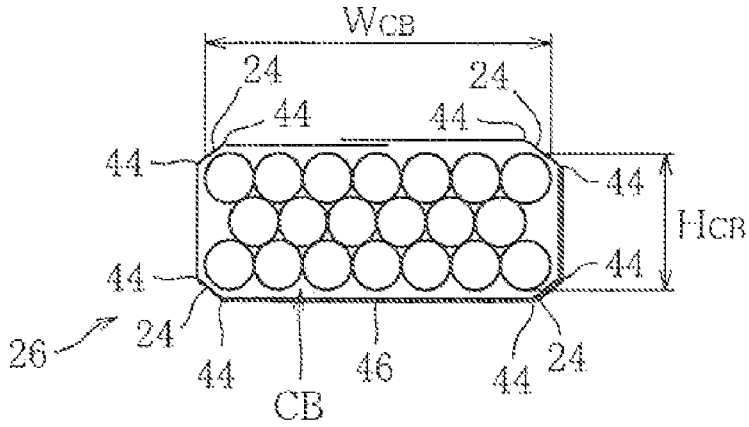
FIG. 6 A diagram showing the inner wrapper formed into a tubular shape, which is the state after the wrapping of the inner wrapper around the cigarette bundle is completed, following the stage shown in FIG. 5.

The two band regions $\mathbf{42}_C$ are located in the central part of the main section 36, and the width $W_1$ between the respective outer mountain fold lines 44 of the band regions $\mathbf{42}_C$ corresponds to the width $W_{CB}$ of the cigarette bundle CB (see FIG. 6). The two band regions $\mathbf{42}_C$ define a center region 46 within the main section 36, and the two band regions $\mathbf{42}_S$ are located on each side of the center region 46.

Regarding the adjacent band regions $\mathbf{42}_S$, $\mathbf{42}_C$, the width $W_2$ between the outer mountain fold line 44 of the band region $\mathbf{42}_S$ and the inner mountain fold line 44 of the band region $\mathbf{42}_C$ corresponds to the height $H_{CB}$ of the cigarette bundle CB. The width $W_3$ between the inner mountain fold line 44 of the band region $42_S$ and the corresponding edge of the main section 36 is smaller than the width $W_1$ and greater than half of the width $W_1$. Thus, when the inner wrapper 26 is wrapped around the cigarette bundle CB, the opposite side ends of the inner wrapper 26 can be laid one on the other.

When the cigarette bundle CB is wrapped in the inner wrapper 26, the upper and lower sections 38, 40 form the top face 28 and bottom face of the inner pack 10. More specifically, as shown in FIG. 4, the upper section 38 has four fold-line groups $48_U$ to form the above-mentioned tucks 34 at the top face 28 of the inner pack 10. The fold-line groups $48_U$ are allotted to the band regions 42, respectively, and each fold-line group has two mountain fold lines 50 and two valley fold lines 52. In FIG. 4, the mountain fold lines 50 are indicated in dashed line, while the valley fold lines 52 in solid line. The valley fold lines 52 are lines impressed on the front side of the inner wrapper 26 to stand out on the backside of the inner wrapper 26.

As clear from FIG. 4, in each fold-line group $48_U$, the mountain fold lines 50 and valley fold lines 42 alternate in the direction of the width of the upper section 38, and each set of a mountain fold line 50 and a valley fold line 52 describes a V-like shape extending from the terminal end of the corresponding mountain fold line 44 of the band region 42 to the upper edge of the upper section 38, so that a V-shaped region 54 is defined between the mountain fold line 50 and the valley fold line 52. Thus, each fold-line group $48_U$ defines two V-shaped regions 54, where the two V-shaped regions do not cross each other. Further, the V-shaped regions 54 define band regions $56_C$, $56_S$ between them, where the band regions $56_C$, $56_S$ form the extensions of the band regions $42_C$, $42_S$, respectively.

More specifically, the band region $56_C$ is inclined toward the widthwise center of the upper section 38, while the band region $56_S$ is inclined toward the widthwise outer side of the upper section 38. Further, the arrangement of the mountain fold line 50 and valley fold line 52 defining the band region $56_C$ is reverse to the arrangement of the mountain fold line 50 and valley fold line 52 defining the band region $56_S$ adjacent to the band region $56_C$. In other words, the valley fold line 52 of the band region $56_C$ is directed to widthwise the center side of the upper section 38, while the valley fold line 52 of the band region $56_S$ is directed to widthwise outer side of the upper section 38.

As clear from FIG. 4, also the lower section 40 has fold-line groups $48_L$ similar to the above-described fold-line groups $48_U$, and the fold-line groups $48_L$ are arranged to form symmetry with the fold-line groups $48_U$. In FIG. 4, the mountain fold lines and valley fold lines in the fold-line groups $48_L$ corresponding to the mountain fold lines 50 and valley fold lines 52 in the fold-line groups $48_U$ are indicated by the same reference signs, and the explanation of these will be omitted.

The inner wrapper 26 shown in FIG. 4 has mountain fold lines 60, 62 which divide the upper section 38 and the lower section 40 from the main section 36, respectively. The mountain fold lines 60, 62 are however not indispensable.

Next, referring to FIGS. 5 to 11, the process of wrapping the cigarette bundle CB in the inner wrapper 26, that is, the process of forming the inner pack 10 will be described.

Figure 5:
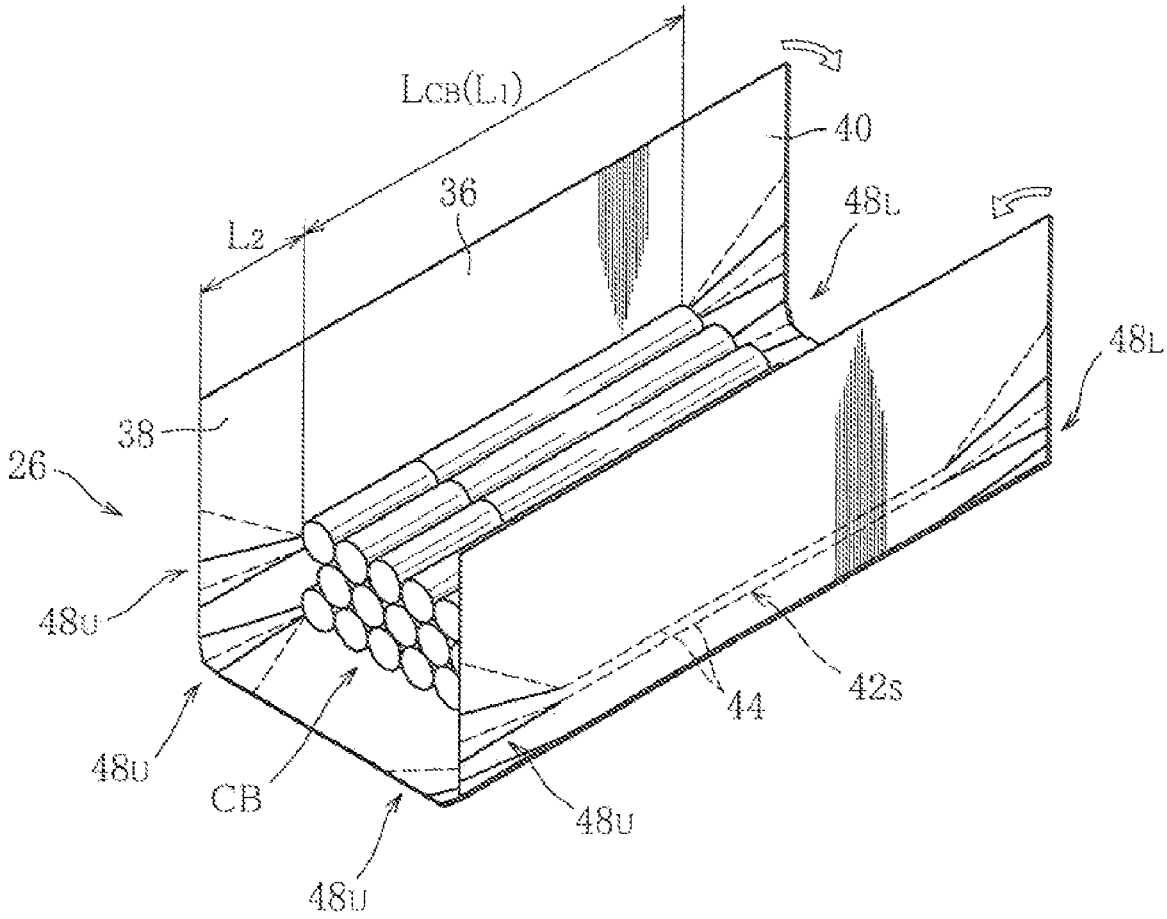

First, the cigarette bundle CB is laid over the center region 46 of the main section 36 of the inner wrapper 26. Then, as shown in FIG. 5, the inner wrapper 26 is bent into a U-shape around the cigarette bundle CB, where the two band regions $42_C$ are bent along the mountain fold lines 44, so that two slant edges 24 are formed at the inner wrapper 26. The two slant edges 24 are placed at the positions corresponding to the lower side edges of the cigarette bundle CB.

Then, the opposite side parts of the U-shaped inner wrapper 26 are folded over the cigarette bundle CB successively, so that the opposite side ends of the inner wrapper 26 are laid one on the other as shown in FIG. 6. Thus, at this time, the inner wrapper 56 is completely wrapped around the cigarette bundle CB and formed into a tubular shape. In this folding step, the two band regions $42_S$ are bent along the mountain fold lines 44 in the same manner as the band regions $42_C$, so that the other two slant edges 24 are formed at the positions corresponding to the upper side edges of the cigarette bundle CB.

Figure 7:
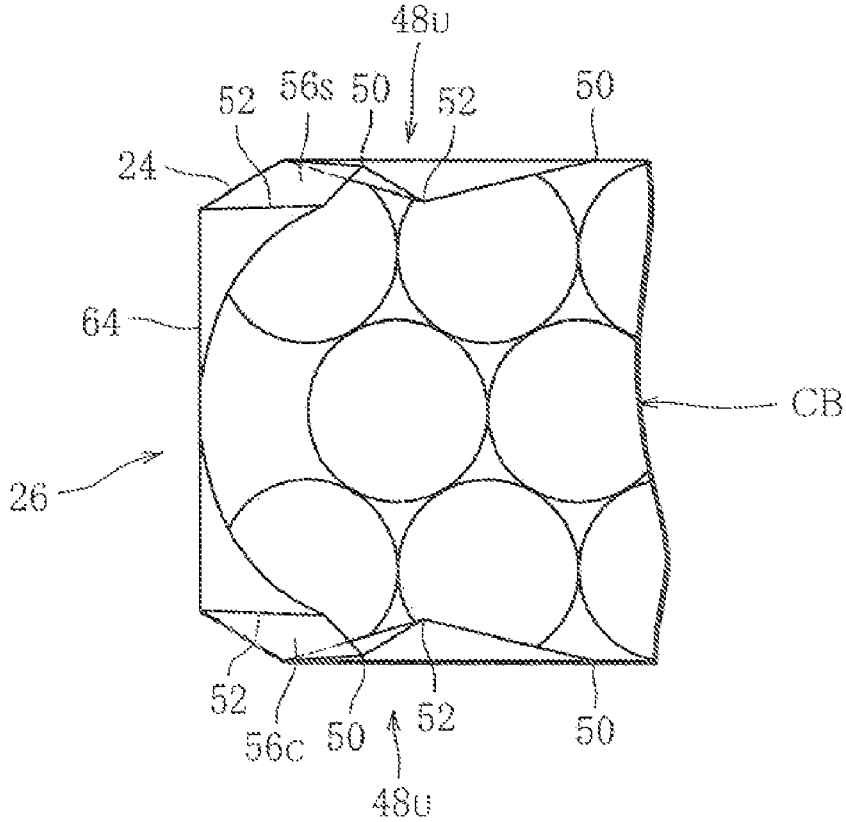
FIG. 7 A diagram partly showing the end of the inner wrapper tube which projects beyond the end face of the cigarette bundle.

The tube-shaped inner wrapper 26 has annular parts projecting beyond each end of the cigarette bundle CB, where these projecting parts are formed from the upper and lower sections 38, 40 of the inner wrapper 26. FIG. 7 partly shows the projecting part 64.

The upper and lower sections 38, 40 have the fold-line groups 48 extending from the band regions 42 (slant edges 24), and these fold-line groups 48 are located at the four corners of each annular projecting part 64. When the projecting parts 64 are formed and therefore the slant edges 24 are formed, the formation of the slat edges 24 causes the corner parts of each projecting part 64 to be bent along the mountain fold lines 50 and valley fold lines 52 in the fold-line groups 48, where the direction of bending along the mountain fold line is opposite to the direction of bending along the valley fold line. Consequently, as clear from FIG. 7, each corner part of the projecting part 64 is formed into a wave-like shape, or a flattened W-like shape.

Figure 8:
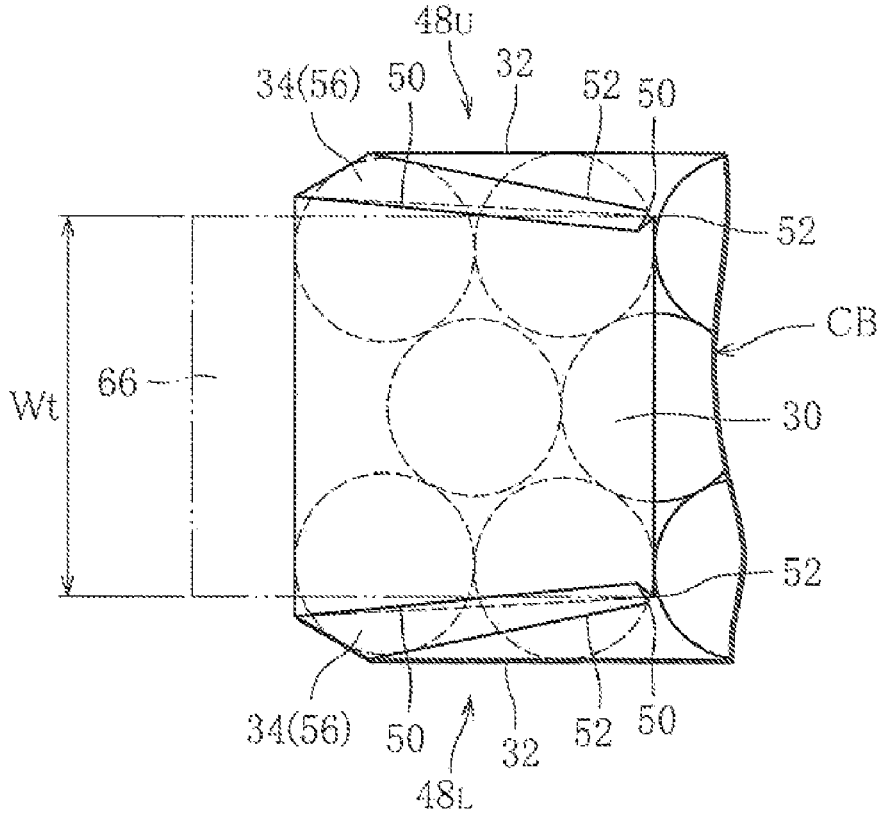
FIG. 8 A diagram showing how the projecting end shown in FIG. 7 is partly bent so that the upper and lower parts of the projecting end are formed into side flaps.

Then, for each projecting part, a pair of plate-shaped tuckers 66 are forced in, from both sides of the projecting part 64 thereto, along the corresponding end face of the cigarette bundle CB, as indicated in two-dot chain line in FIG. 8, so that the both sides of the projecting part 64 are bent over the end face of the cigarette bundle CB along the left and right sides of the end face of the bundle CB as viewed in FIG. 7.

Figure 9:
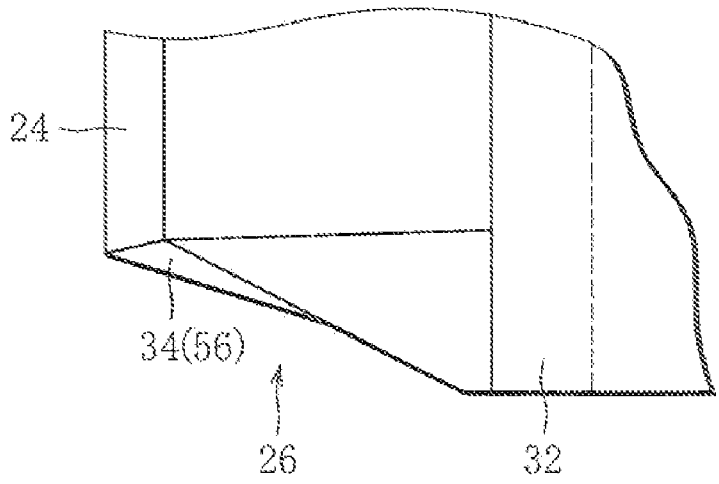
FIG. 9 A plan view showing the projecting end of FIG. 8.

In this folding step, a pair of end flaps 30 laid over the end face of the cigarette bundle CB, and upper and lower side flaps 32 are formed from the projecting part 64, and each corner part of the projecting part 64 is more deeply bent, along the mountain fold lines 50 and valley fold lines 52. Consequently, in the projection view of the end face of the cigarette bundle CB, each band region 56 of the projecting part 64 which is to form a tuck 34 overlaps the end flap 30, as shown in FIGS. 8 and 9.

In order to fold the left and right sides of the projecting part 64 with certainty, it is desirable that the width Wt (FIG. 8) of the end of the tucker 66 should correspond to the minimum distance Wn (FIG. 4) between the upper and lower fold-line groups 48.

Figure 10:
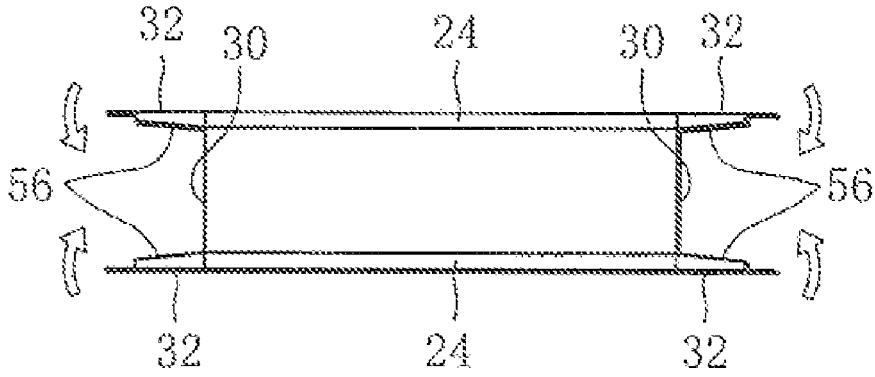
FIG. 10 A diagram showing how the side flaps project from each end face of the cigarette bundle.
Figure 11:
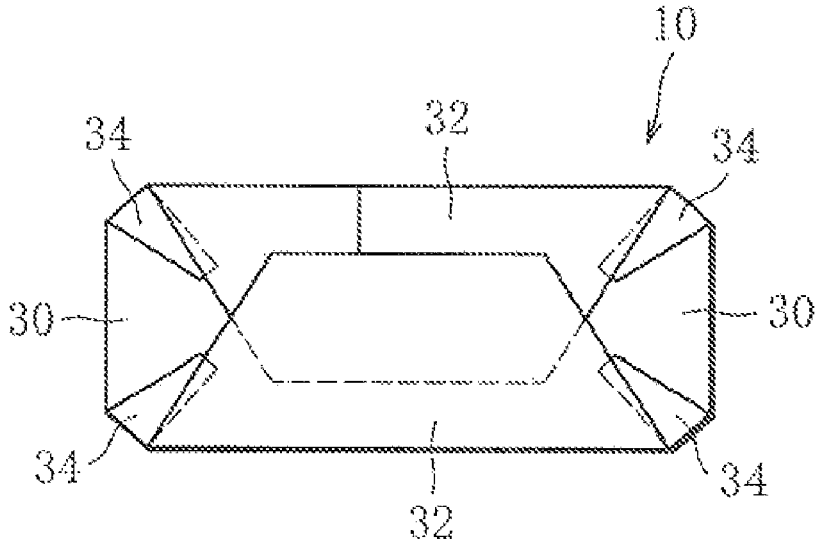
FIG. 11 A diagram showing how the end face of the cigarette bundle is covered with a closure surface (top or end face) of the inner pack formed by folding down the side flaps.

Then, as indicated by arrows in FIG. 10, the upper and lower side flaps 32 are folded down onto the corresponding end face of the cigarette bundle CB, or in other words, onto the left and right end flaps 30, successively. The side flaps 32 are laid one on the other, in the manner such that each band region 56 comes between one of the end flaps 30 and one of the side flaps 32. Thus, as shown in FIG. 11, each band region 56 is formed into a tuck 34 lying between one of the end flaps 30 and one of the side flaps 32.

The end flaps 30, the pair of side flaps 32, and the tucks 34 constitute a closure surface covering the corresponding end face of the cigarette bundle CB. Thus, the inner pack 10 has the upper face 28 and the bottom face formed as such closure surfaces.

Figure 12:
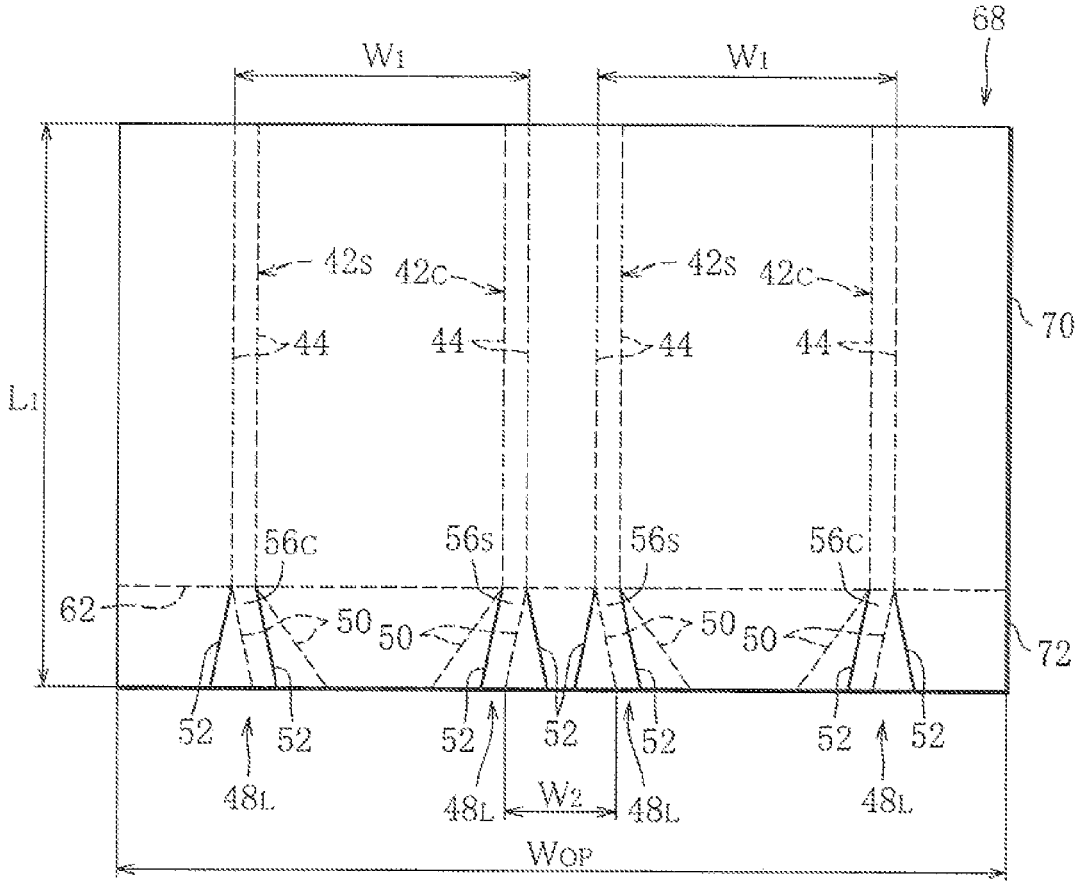
FIG. 12 A diagram showing an outer wrapper in an unfolded state.

FIG. 12 shows an outer wrapper 68 which is to form the envelope 12, in an unfolded state.

The outer wrapper 68 comprises a main section 70 and a lower section 72 similar to the main section 36 and lower section 40 of the inner wrapper 26. Thus, in FIG. 12, the band regions in the main section 70 and the fold-line groups in the lower section 72 corresponding to the band regions 42 in the main section 36 and the fold-line groups 48 in the lower section 40 are indicated by the same reference signs, and the explanation of these will be omitted. Only the aspects in which the outer wrapper 68 differs from the inner wrapper 26 will be described below.

In the outer wrapper 68, the band regions $\mathbf{42}_C$, $\mathbf{42}_S$ of the main section 70 are arranged to alternate in the direction of the width of the main section 70. This is to arranged that the overlap of the outer wrapper 68, namely the overlapping part formed by the opposite side ends of the outer wrapper 68 is located on one of the side faces of the inner pack 10, not on the back face of the inner pack 10. The opposite side ends of the outer wrapper 68 are bonded together. The width $W_{OP}$ of the outer wrapper 68 is smaller than the width $W_{IP}$ of the inner wrapper 26, so that the overlap of the outer wrapper 68 is narrower than the overlap of the inner wrapper 26.

Although the arrangement of the band regions $\mathbf{42}_C$, $\mathbf{42}_S$ is different from that in the inner wrapper as mentioned above, each band region 42 likewise forms a slant edge 20 of the envelope 12, when the outer wrapper 68 is wrapped around the inner pack 10.

Figure 13:
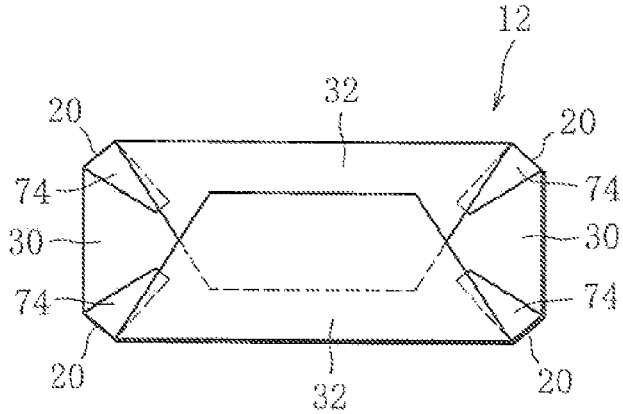
FIG. 13 A diagram showing a bottom face of the soft package formed from the outer wrapper.

The annular projecting part formed from the lower section 72 of the outer wrapper 68 is folded in the same manner as the above-described projecting part 64, thereby forming a closure surface as shown in FIG. 13, that is, the bottom face of the envelope 12. Specifically, this bottom face of the envelope 12 includes tucks 74 each formed from a band region 56 of the lower section 72, and each tuck lies between one of the end flaps 30 and one of the side flaps 32, partly covered by the relevant side flap 32 and partly exposed.

The pair of side flaps 32 constituting the bottom face of the envelope 12 are bonded together, and the seal 14 is stuck to the upper face 28 of the inner pack 10.

The present invention is not restricted to the above-described embodiment, but various modifications can be made to it.

For example, in the described embodiment, both the envelope 12 and the inner pack 10 have the slant edges 20, 24. It can however be arranged such that only the envelope 12 has the slant edges 20. Also in this case, the soft package can have an octagonal transverse cross section.

Further, for the inner wrapper 26 covering the cigarette bundle CB, not only aluminum-vapor-deposited paper but also other various wrapping materials can be used. For example, the inner wrapper can be one having a layer for blocking the passage of moisture or an aroma, within itself.

Further, the manner of folding the inner and outer wrappers to form the upper face 28 and bottom face of the inner pack 10 and the bottom face of the envelope 12 is not restricted to that shown in the drawings.

The invention claimed is:

1. A soft package of rod-shaped smoking articles, comprising:

an inner pack of an almost rectangular parallelepiped, the inner pack including a bundle of rod-shaped smoking articles and an inner wrapper covering the bundle, and an envelope of an almost rectangular parallelepiped, the envelope covering said inner pack except for a top face of said inner pack and including four corner edges extending along a longitudinal direction of said inner pack, wherein said envelope further includes slant edges formed at the corner edges, respectively, said slant edges imparting an octagonal transverse cross section to said envelope, wherein said envelope is formed by folding an outer wrapper around said inner pack and includes an outer bottom face of a rectangular shape covering a bottom face of said inner pack, and said outer bottom face includes a pair of end flaps located at opposite ends of said outer bottom face, a pair of trapezoidal side flaps extending along each side edge of said outer bottom face and laid one on the other on the end flaps, and tucks extending from the slant edges, respectively, and each lying between one of the end flaps and one of the side flaps, partly covered by the relevant side flap and partly exposed.

2. The soft package according to claim 1, wherein said inner pack is formed by folding the inner wrapper, and has slant edges corresponding to the sloping edges of said envelope, said slant edges imparting to said inner pack an octagonal transverse cross section similar to that of said envelope.

3. The soft package according to claim 2, wherein the top and bottom faces of said inner pack are formed by the same manner of folding as said outer bottom face of said envelope is formed, and include tucks corresponding to the tucks of said outer bottom face.

4. An outer wrapper for a cigarette package, where the cigarette package comprises an inner pack of an almost rectangular parallelepiped, the inner pack containing a bundle of rod-shaped smoking articles and an envelope of an almost rectangular parallelepiped, the envelope being formed by folding the outer wrapper to cover the inner pack except for a top face of the inner pack, the envelope including four corner edges extending along the longitudinal direction of the inner pack, the outer wrapper comprising:

a rectangular main section of a length corresponding to a length of the inner pack and a width allowing said main section to be wrapped around the inner pack, four band regions defined by fold lines within said main section to be apart from each other in the direction of the width of said main section, said four band regions being bent along the fold lines, thereby forming slant edges at the corner edges when said main section is wrapped around the inner pack, and a subsection adjacent to said main section at a lengthwise end of said main section and having the same width as said main section, said subsection forming an outer bottom face covering a bottom face of the inner pack after said main section is wrapped around the inner pack, wherein said outer bottom face includes a pair of end flaps located at opposite ends of said outer bottom face, and a pair of trapezoidal side flaps extending along each side edge of said outer bottom face and laid one on the other on the end flaps, wherein said subsection includes fold-line groups allotted to said four band regions, respectively, said fold-line groups each forming a tuck extending from the corresponding slant edge and lying between one of the end flaps and one of the side flaps, partly covered by the relevant side flap and partly exposed, when said subsection is folded.

5. The outer wrapper according to claim 4, wherein said fold-line groups each include two sets of a mountain fold line and a valley fold line extending from the corresponding fold line of said corresponding band region up to an outer edge of said subsection divergently, thereby describing a V-shape, where the two sets of a mountain fold line and a valley fold line are arranged such that the mountain fold lines and the valley fold lines alternate in a direction of the width of said subsection.

6. An inner wrapper for a cigarette package, where the cigarette package comprises an inner pack of an almost rectangular parallelepiped, the inner pack being obtained by wrapping a bundle of rod-shaped smoking articles in the inner wrapper and an envelope of an almost rectangular parallelepiped, the envelope being formed by folding an outer wrapper to cover the inner pack except for a top face of the inner pack, the envelope including four slant edges extending along a longitudinal direction of the inner pack, the inner wrapper comprising:

a rectangular main section of a length corresponding to a length of the rod-shaped article and a width allowing said main section to be wrapped around the bundle, four band regions defined by fold lines within said main section to be apart from each other in a direction of the width of said main section, said four band regions being bent along the fold lines, thereby forming slant edges corresponding to the four slant edges of the envelope, when said main section is wrapped around the bundle, and a pair of subsections adjacent to said main section at each lengthwise end of said main section and having the same width as said main section, said subsections forming top and bottom faces covering each end face of the bundle after said main section is wrapped around the bundle, wherein the top and bottom faces each include a pair of end flaps located at opposite ends of the face, and a pair of trapezoidal side flaps extending along each side edge of the face and laid one on the other on the end flaps, wherein said subsections each include fold-line groups allotted to said four band regions, respectively, the fold-line groups each forming a tuck extending from the corresponding slant edge and lying between one of the end flaps and one of the side flaps, partly covered by the relevant side flap and partly exposed, when said subsections are folded.

7. The inner wrapper according to claim 6, wherein the fold-line groups each include two sets of a mountain fold line and a valley fold extending from the corresponding fold line of said corresponding band region up to an outer edge of said subsection divergently, thereby describing a V-shape, where the two sets of a mountain fold line and a valley fold line are arranged such that the mountain fold lines and the valley fold lines alternate in a direction of the width of said subsection.

* * * * *